US008370991B2

(12) United States Patent
Paliobeis et al.

(10) Patent No.: US 8,370,991 B2
(45) Date of Patent: Feb. 12, 2013

(54) SUPPLY TANK ASSEMBLY FOR AN EXTRACTOR CLEANING MACHINE

(75) Inventors: Steven J. Paliobeis, Mentor, OH (US); Robert A. Salo, Mentor, OH (US)

(73) Assignee: Techtronic Floor Care Technology Limited, Tortola (VG)

( * ) Notice: Subject to any disclaimer, the term of this patent is extended or adjusted under 35 U.S.C. 154(b) by 350 days.

(21) Appl. No.: 12/874,000

(22) Filed: Sep. 1, 2010

(65) Prior Publication Data

US 2012/0047677 A1 Mar. 1, 2012

(51) Int. Cl.
*A47L 7/00* (2006.01)

(52) U.S. Cl. ..... 15/320; 15/327.1

(58) Field of Classification Search ..... 15/320, 15/321, 327.1, 352, 353, 410
See application file for complete search history.

(56) References Cited

U.S. PATENT DOCUMENTS

| | | | | |
|---|---|---|---|---|
| 2,986,764 | A | 6/1961 | Krammes | |
| 3,040,362 | A | 6/1962 | Krammes | |
| 4,558,484 | A | 12/1985 | Groth | |
| 5,189,755 | A | 3/1993 | Yonkers et al. | |
| 5,289,611 | A | 3/1994 | Yonkers et al. | |
| 5,493,752 | A | 2/1996 | Crouser et al. | |
| 5,500,977 | A | 3/1996 | McAllise et al. | |
| 5,735,017 | A | 4/1998 | Barnes et al. | |
| 5,784,755 | A | 7/1998 | Karr et al. | |
| 5,896,617 | A | 4/1999 | Kasen et al. | |
| 5,983,442 | A * | 11/1999 | Louis et al. | 15/320 |
| 6,041,472 | A | 3/2000 | Kasen et al. | |
| 6,082,376 | A * | 7/2000 | Karr et al. | 134/6 |
| 6,131,237 | A | 10/2000 | Kasper et al. | |
| 6,134,744 | A | 10/2000 | Kasen et al. | |
| 6,158,081 | A * | 12/2000 | Kasen et al. | 15/320 |
| 6,167,586 | B1 | 1/2001 | Reed, Jr. et al. | |
| 6,192,549 | B1 | 2/2001 | Kasen et al. | |
| 6,230,362 | B1 | 5/2001 | Kasper et al. | |
| 6,286,180 | B1 | 9/2001 | Kasper et al. | |
| 6,325,864 | B1 * | 12/2001 | Zahuranec et al. | 134/21 |
| 6,401,294 | B2 | 6/2002 | Kasper | |

(Continued)

FOREIGN PATENT DOCUMENTS

| | | |
|---|---|---|
| GB | 2334667 | 9/1999 |
| GB | 2334668 | 9/1999 |

(Continued)

OTHER PUBLICATIONS

International Search Report and Written Opinion for Application No. PCT/US2011/050141 dated Apr. 27, 2012 (8 pages).

*Primary Examiner* — Dung Van Nguyen
(74) *Attorney, Agent, or Firm* — Michael Best & Friedrich LLP

(57) ABSTRACT

An extractor cleaning machine includes a supply tank assembly having a first tank and a second tank. The first tank is in fluid communication with a distributor. The first tank has a rigid body defining a first storage chamber for storing a first cleaning fluid and supplying the first cleaning fluid to the distributor. The second tank is positioned within the first storage chamber of the first tank in fluid communication with the distributor. The second tank has a rigid body defining a second storage chamber for receiving a second cleaning fluid and supplying the second cleaning fluid to the distributor. At least a portion of the rigid body of the second tank defines a boundary of the first storage chamber to separate the first cleaning fluid and the second cleaning fluid.

28 Claims, 5 Drawing Sheets

U.S. PATENT DOCUMENTS

| | | | |
|---|---|---|---|
| 6,412,141 | B2 | 7/2002 | Kasper et al. |
| 6,421,862 | B2 | 7/2002 | Lesco et al. |
| 6,513,188 | B2 | 2/2003 | Zahuranec et al. |
| 6,609,268 | B2 | 8/2003 | Miner |
| 6,880,199 | B1 | 4/2005 | Huffman et al. |
| 6,898,820 | B2 | 5/2005 | Kasper et al. |
| D530,473 | S | 10/2006 | Medema et al. |
| D533,698 | S | 12/2006 | Medema et al. |
| 7,159,271 | B2 | 1/2007 | Sepke et al. |
| 7,240,394 | B2 | 7/2007 | Kegg et al. |
| 7,269,879 | B2 | 9/2007 | Kegg et al. |
| 7,322,071 | B2 | 1/2008 | Lee et al. |
| 7,331,082 | B2 * | 2/2008 | Hertrick et al. ..... 15/320 |
| 7,475,712 | B2 | 1/2009 | McDowell |
| 7,617,563 | B2 | 11/2009 | Hertrick et al. |
| 2005/0102788 | A1 | 5/2005 | Pritts |
| 2006/0288518 | A1 | 12/2006 | Lenkiwicz et al. |
| 2007/0226943 | A1 | 10/2007 | Lenkiewicz et al. |
| 2009/0089957 | A1 | 4/2009 | Lenkiewicz |
| 2009/0119868 | A1 | 5/2009 | Lenkiewicz et al. |

FOREIGN PATENT DOCUMENTS

| | | |
|---|---|---|
| GB | 3022316 | 10/2005 |
| GB | 3022317 | 10/2005 |

* cited by examiner

SUPPLY TANK ASSEMBLY FOR AN EXTRACTOR CLEANING MACHINE

BACKGROUND

The present invention relates to extractor cleaning machines and, more particularly, to supply tank assemblies for extractor cleaning machines.

Extractor cleaning machines typically include tanks that dispense premixed water and detergent for cleaning a surface. Some extractor cleaning machines include two separate tanks for water and for detergent such that the water and detergent may be mixed when needed. Other extractor cleaning machines include detergent tanks combined with water tanks into a single assembly. Often, these tanks include flexible membranes that separate the cleaning fluids in each tank. Furthermore, the tanks must typically be removed from the extractor cleaning machines in order to access fill openings of the tanks.

SUMMARY

In one embodiment, the invention provides an extractor cleaning machine including a foot movable along a surface to be cleaned. The foot includes a distribution nozzle and a suction nozzle. The extractor cleaning machine also includes a handle coupled to the foot to facilitate movement of the foot along the surface and a suction source in fluid communication with the suction nozzle. The suction source is operable to draw fluid and dirt from the surface through the suction nozzle. The extractor cleaning machine further includes a recovery tank coupled to at least one of the foot and the handle. The recovery tank is in fluid communication with the suction source to receive and store the fluid and dirt drawn through the suction nozzle. The extractor cleaning machine also includes a distributor in fluid communication with the distribution nozzle. The distributor is operable to distribute a first cleaning fluid and a second cleaning fluid to the surface through the distribution nozzle. The extractor cleaning machine further includes a supply tank assembly coupled to at least one of the foot and the handle. The supply tank assembly includes a first tank in fluid communication with the distributor. The first tank has a rigid body defining a first storage chamber for storing the first cleaning fluid and supplying the first cleaning fluid to the distributor. The supply tank assembly also includes a second tank positioned within the first storage chamber of the first tank in fluid communication with the distributor. The second tank has a rigid body defining a second storage chamber for receiving the second cleaning fluid and supplying the second cleaning fluid to the distributor. At least a portion of the rigid body of the second tank defines a boundary of the first storage chamber to separate the first cleaning fluid and the second cleaning fluid.

In another embodiment, the invention provides an extractor cleaning machine including a foot movable along a surface to be cleaned. The foot includes a distribution nozzle and a suction nozzle. The extractor cleaning machine also includes a handle coupled to the foot to facilitate movement of the foot along the surface and a suction source in fluid communication with the suction nozzle. The suction source is operable to draw fluid and dirt from the surface through the suction nozzle. The extractor cleaning machine further includes a recovery tank coupled to at least one of the foot and the handle. The recovery tank is in fluid communication with the suction source to receive and store the fluid and dirt drawn through the suction nozzle. The extractor cleaning machine also includes a distributor in fluid communication with the distribution nozzle. The distributor is operable to distribute a first cleaning fluid and a second cleaning fluid to the surface through the distribution nozzle. The extractor cleaning machine further includes a supply tank assembly coupled to at least one of the foot and the handle. The supply tank assembly includes a base defining a first outlet for supplying the first cleaning fluid to the distributor and a second outlet for supplying the second cleaning fluid to the distributor, and an exterior sidewall extending upwardly from the base. The exterior sidewall includes a bottom end coupled to the base and a top end opposite the bottom end. The supply tank assembly also includes an upper portion coupled to the top end of the exterior sidewall opposite the base. The upper portion, the base, and the exterior sidewall together define a storage volume of the supply tank assembly. The supply tank assembly further includes a first tank for storing the first cleaning fluid. The first tank is defined by at least a portion of the exterior sidewall, at least a portion of the upper portion, and a portion of the base. The supply tank assembly also includes a first tank inlet for filling the first tank. The first tank inlet extends through the upper portion of the supply tank assembly. The supply tank assembly further includes an interior sidewall extending upwardly from the base and located within the storage volume, and a second tank for storing the second cleaning fluid. The second tank is at least partially defined by the interior sidewall, at least a portion of the upper portion, and a portion of the base. The supply tank assembly also includes a second tank inlet for filling the second tank. The second tank inlet extends through the upper portion of the supply tank assembly.

In yet another embodiment, the invention provides an extractor cleaning machine including a foot movable along a surface to be cleaned. The foot includes a distribution nozzle and a suction nozzle. The extractor cleaning machine also includes a handle coupled to the foot to facilitate movement of the foot along the surface and a suction source in fluid communication with the suction nozzle. The suction source is operable to draw fluid and dirt from the surface through the suction nozzle. The extractor cleaning machine further includes a recovery tank coupled to at least one of the foot and the handle. The recovery tank is in fluid communication with the suction source to receive and store the fluid and dirt drawn through the suction nozzle. The extractor cleaning machine also includes a distributor in fluid communication with the distribution nozzle. The distributor is operable to distribute a first cleaning fluid and a second cleaning fluid to the surface through the distribution nozzle. The extractor cleaning machine further includes a supply tank assembly coupled to at least one of the foot and the handle. The supply tank assembly includes a base defining a first outlet for supplying the first cleaning fluid to the distributor and a second outlet for supplying the second cleaning fluid to the distributor, and an exterior sidewall extending from the base. The exterior sidewall includes a first end coupled to the base and a second end opposite the first end. The supply tank assembly also includes an upper portion coupled to the second end of the exterior sidewall opposite the base. The upper portion, the exterior sidewall, and the base together define a storage volume of the supply tank assembly. The supply tank assembly further includes a tube positioned within the storage volume. The tube extends between the base and the upper portion to interconnect the base and the upper portion. The supply tank assembly also includes a first tank for storing the first cleaning fluid. The first tank is defined by the exterior sidewall, a portion of the upper portion, and a portion of the base. The supply tank assembly further includes a second tank for storing the second cleaning fluid. The second tank is defined by the tube, a portion of the upper portion, and a portion of the base.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
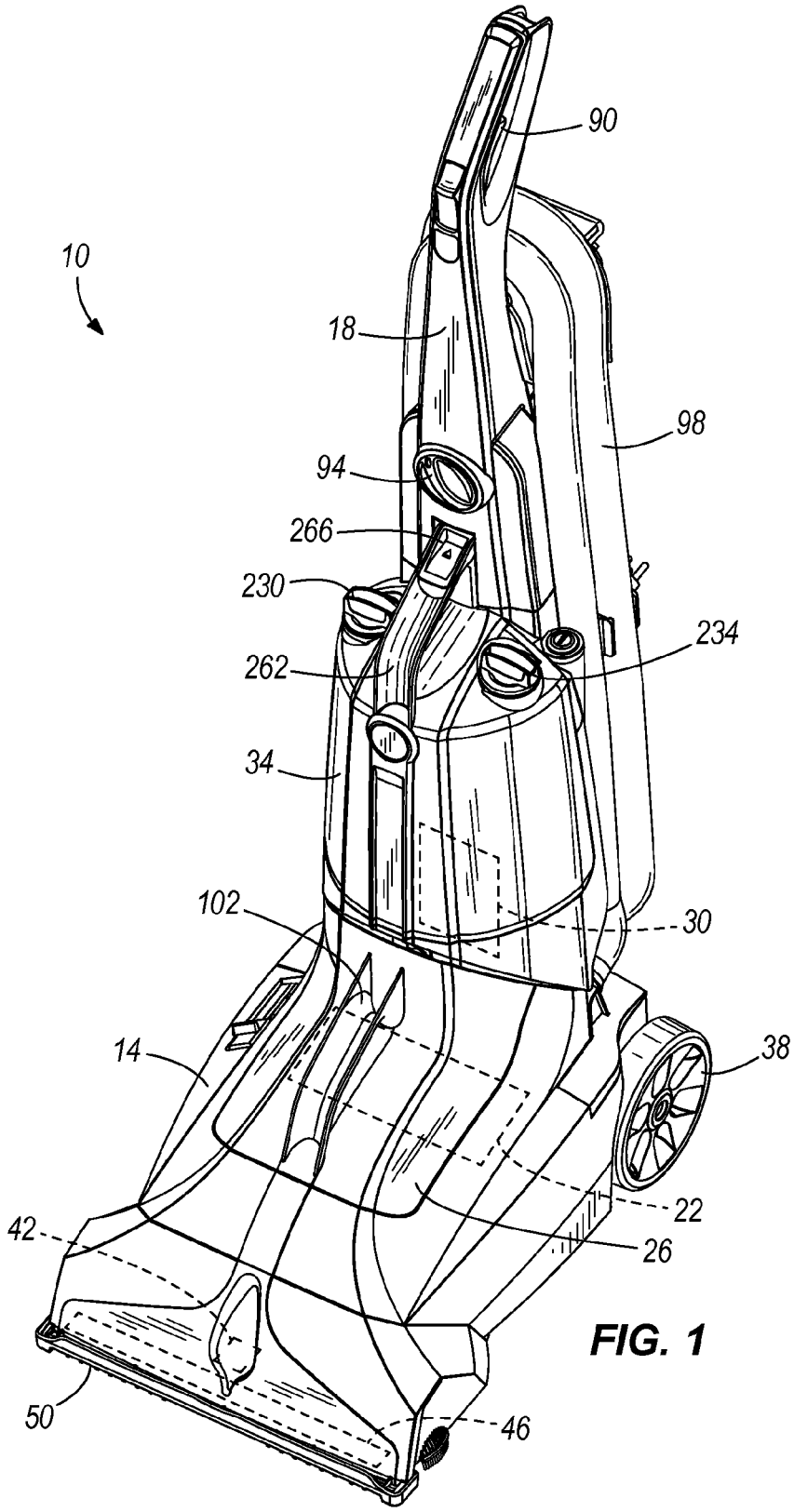
FIG. 1 is a perspective view of an extractor cleaning machine embodying the invention.

FIG. 1 illustrates an extractor cleaning machine 10 (hereinafter referred to simply as an "extractor"). In the illustrated embodiment, the extractor 10 is an upright extractor operable to clean a surface, such as, for example, a floor. In some embodiments, the extractor 10 may be adapted to clean a variety of surfaces, such as carpets, hardwood floors, tiles, or the like. The extractor 10 distributes or sprays a cleaning fluid (e.g., water, detergent, or a mixture of water and detergent) onto the surface to clean the surface. The extractor 10 then draws the cleaning fluid and any dirt off of the surface, leaving the surface relatively clean and dry.

The illustrated extractor 10 includes a base or foot 14, a handle 18 coupled to the foot 14, a suction source 22 supported by the foot 14, a recovery tank 26 coupled to the foot 14, a distributor 30 supported by the handle 18, and a supply tank assembly 34 coupled to the handle 18. The foot 14 is movable along the surface to be cleaned and supports the other components of the extractor 10. Two wheels 38 (only one of which is shown in FIG. 1) are coupled to the foot 14 to facilitate movement of the foot 14 along the surface. In the illustrated embodiment, the wheels 38 are idle wheels. In other embodiments, the wheels 38 may be driven wheels.

As shown in FIG. 1, the foot 14 includes a distribution nozzle 42, a suction nozzle 46, and a brush assembly 50. The distribution nozzle 42 is coupled to a lower surface of the foot 14 to direct cleaning fluid toward the surface. The suction nozzle 46 is also coupled to the lower surface of the foot 14 to draw fluid and dirt from the surface back into the recovery tank 26 of the extractor 10. The brush assembly 50 is coupled to the lower surface of the foot 14 adjacent the nozzles 42, 46 to scrub the surface. The brush assembly 50 also helps inhibit fluid from flowing beyond a periphery of the foot 14. In some embodiments, individual brushes of the brush assembly 50 may be electrically or pneumatically rotated to agitate and scrub the surface.

The illustrated handle 18 is pivotally coupled to and extends from the foot 14. The handle 18 is pivotable or tiltable relative to the foot 14 from the generally vertical storage position shown in FIG. 1 to an infinite number of non-vertical operating positions. Pivoting the handle 18 to an operating position facilitates moving the foot 14 along the surface.

Figure 2:
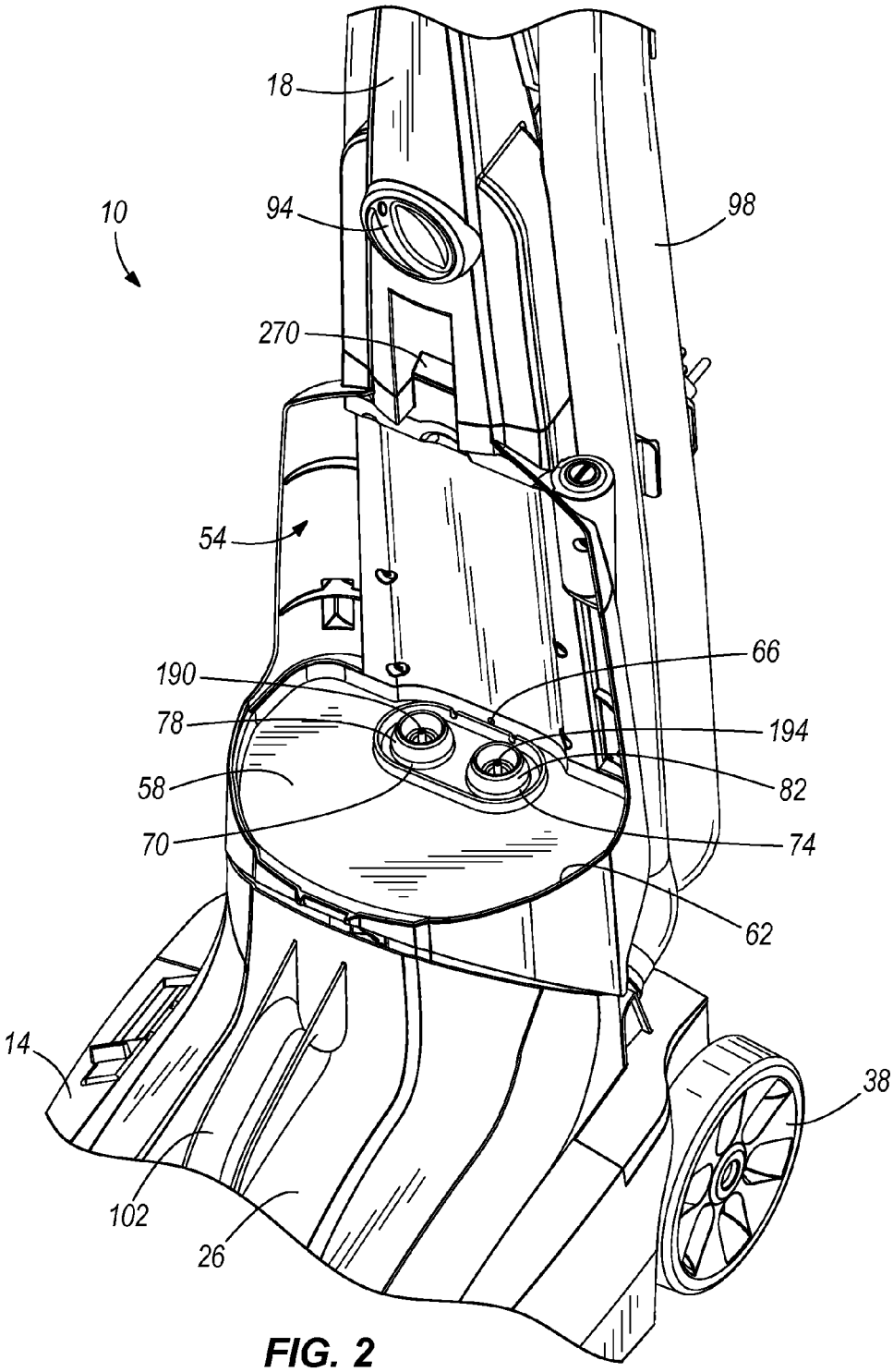
FIG. 2 is a perspective view of a portion of the extractor cleaning machine shown in FIG. 1 with a supply tank assembly removed.
Figure 3:
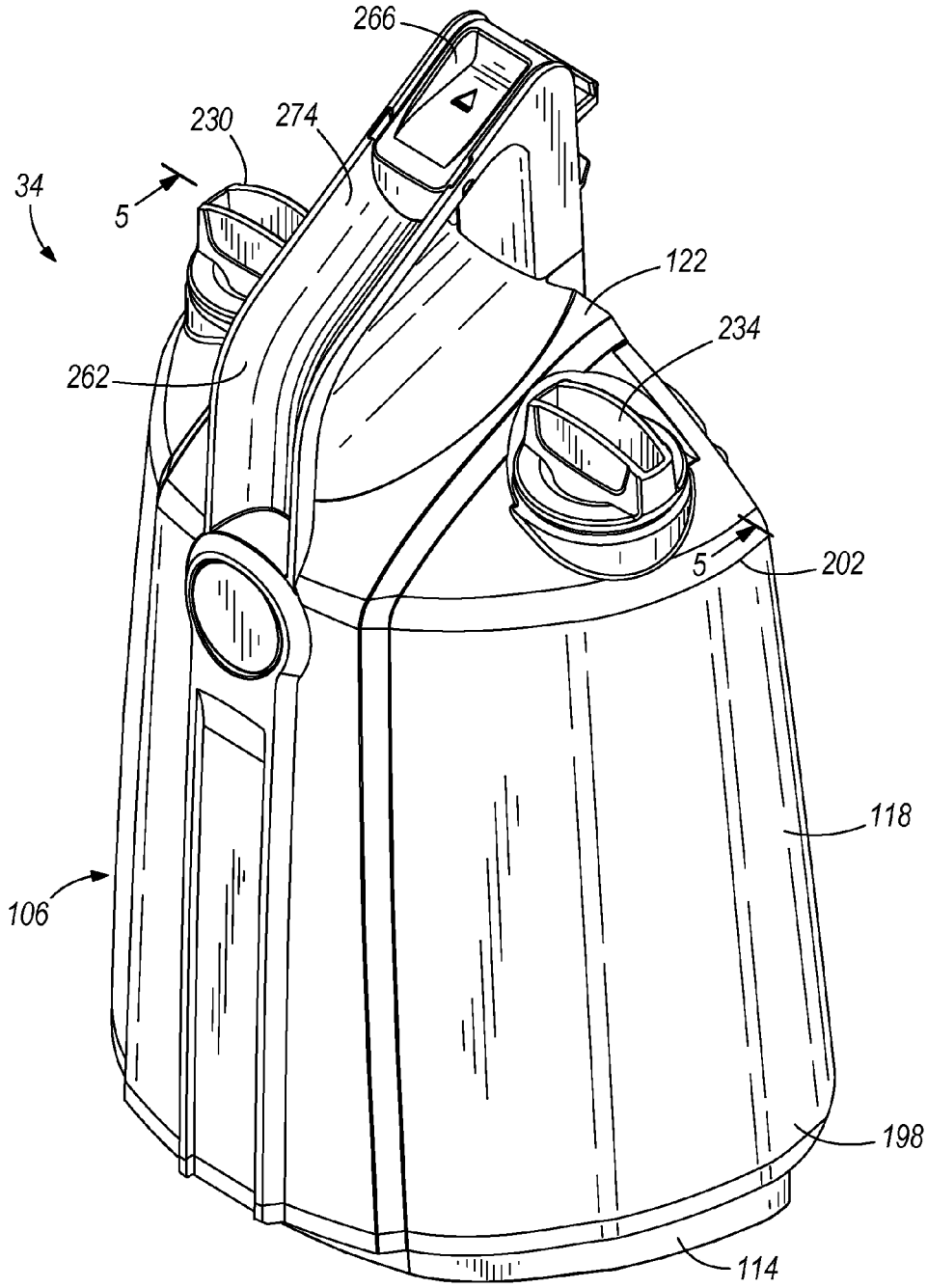
FIG. 3 is an enlarged perspective view of the supply tank assembly.

As shown in FIG. 2, the handle 18 defines a cavity 54 and includes a tank tray 58 for receiving and supporting the supply tank assembly 34 (FIG. 3). A lip 62 is formed about the perimeter of the tray 58 to inhibit spilt fluid from flowing uncontrollably off of the tray 58. The lip 62 defines a drain 66 that directs fluid on the tray 58 to the backside of the extractor 10 and down toward the surface. The tank tray 58 also includes connectors 70, 74 that couple to the supply tank assembly 34 to bring the tank assembly 34 into fluid communication with the distributor 30. In the illustrated embodiment, the tank tray 58 includes two connectors 70, 74. In other embodiments, the tank tray 58 may include fewer or more connectors. A rubber gasket 78, 82 surrounds each connector 70, 74 to inhibit fluid from leaking out of the supply tank assembly 34 when the tank assembly 34 is coupled to the connectors 70, 74. In other embodiments, the gasket may be made from materials other than rubber such as other resilient or rigid materials.

Referring back to FIG. 1, the handle 18 supports a trigger 90 and a mode knob 94. The trigger 90 is actuatable to spray cleaning fluid from the supply tank assembly 34 through the distribution nozzle 42 and onto the surface. The mode knob 94 adjusts the operating mode of the extractor 10. For example, the mode knob 94 may be rotated to control the amount of cleaning fluid distributed by the extractor 10 onto the surface. The illustrated handle 18 also supports an accessory hose 98. The accessory hose 98 is connectable to a variety of hand-held tools to help clean smaller surfaces, such as, for example, steps.

The suction source 22 is in fluid communication with the suction nozzle 46 to draw fluid and dirt from the surface through the nozzle 46. In some embodiments, the suction source 22 may include a fan that generates a vacuum to draw the fluid and dirt through the nozzle 46. In the illustrated embodiment, the suction source 22 is supported by the foot 14 generally underneath the recovery tank 26. In other embodiments, the suction source 22 may be supported by the handle 18 or may be positioned elsewhere on the extractor 10.

The recovery tank 26 is in fluid communication with the suction source 22 and the suction nozzle 46 to receive and store the fluid and dirt drawn through the nozzle 46. The illustrated recovery tank 26 is removably coupled to an upper surface of the foot 14. The recovery tank 26 includes a lift handle 102 to facilitate removing and handling the tank 26 apart from the extractor 10. In other embodiments, the recovery tank 26 may be supported by the handle 18 of the extractor 10.

The distributor 30 is in fluid communication with the distribution nozzle 42 to draw cleaning fluid from the supply tank assembly 34 and distribute the fluid to the surface through the distribution nozzle 42. The illustrated distributor 30 draws two separate cleaning fluids (e.g., water and detergent) from the supply tank assembly 34, mixes the fluids, and distributes the mixed cleaning fluid onto the surface. Actuating the power/mode knob 94 adjusts the mixing ratio of the two cleaning fluids or the amount of cleaning fluid that is distributed. In some embodiments, the distributor 30 may include a pump that propels the cleaning fluid to the distribution nozzle 42. In the illustrated embodiment, the distributor 30 is supported by the handle 18 generally behind the supply tank assembly 34. In other embodiments, the distributor 30 may be supported by the foot 14 or may be positioned elsewhere on the extractor 10.

Figure 4:
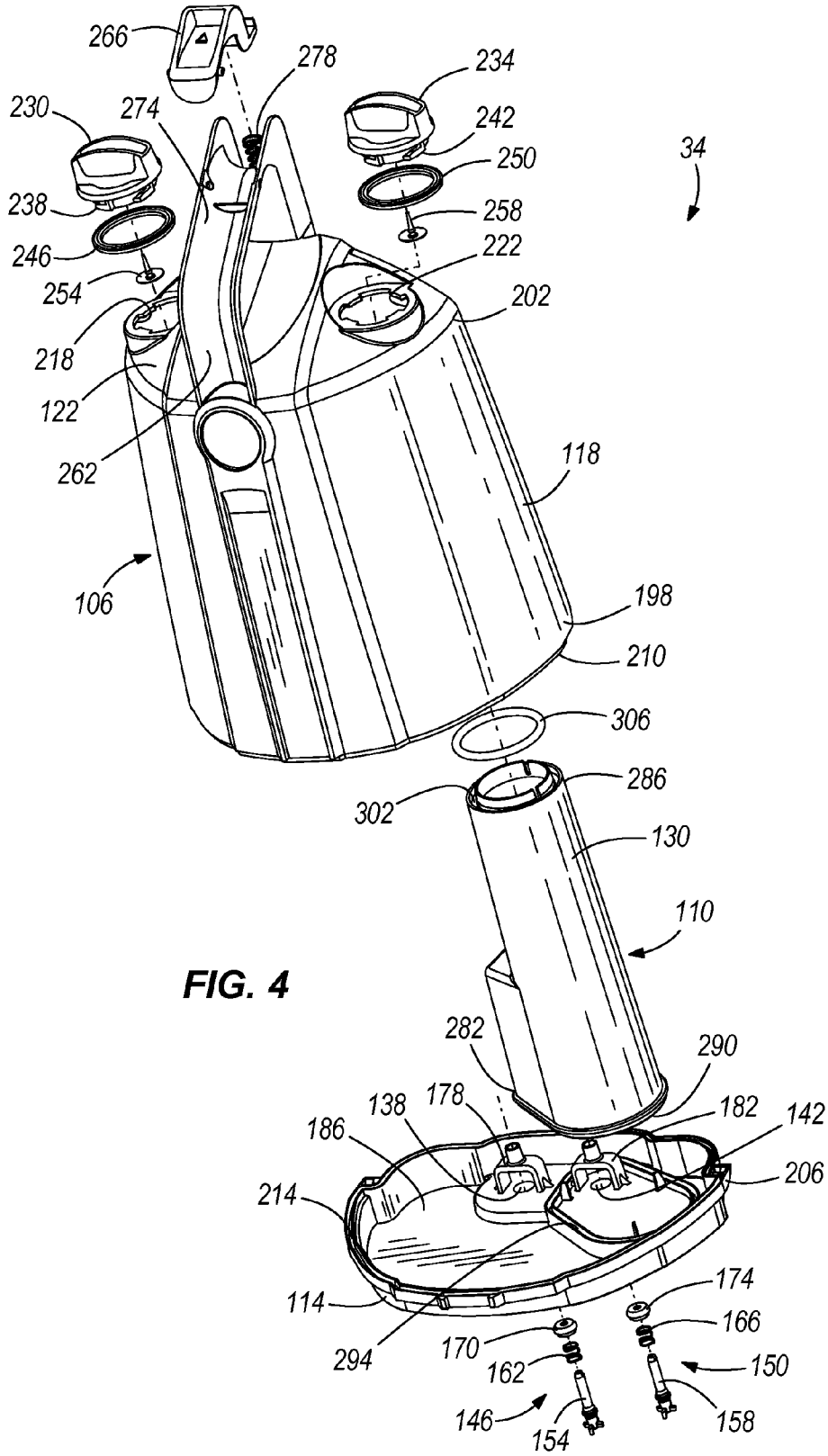
FIG. 4 is an exploded perspective view of the supply tank assembly shown in FIG. 2.
Figure 5:
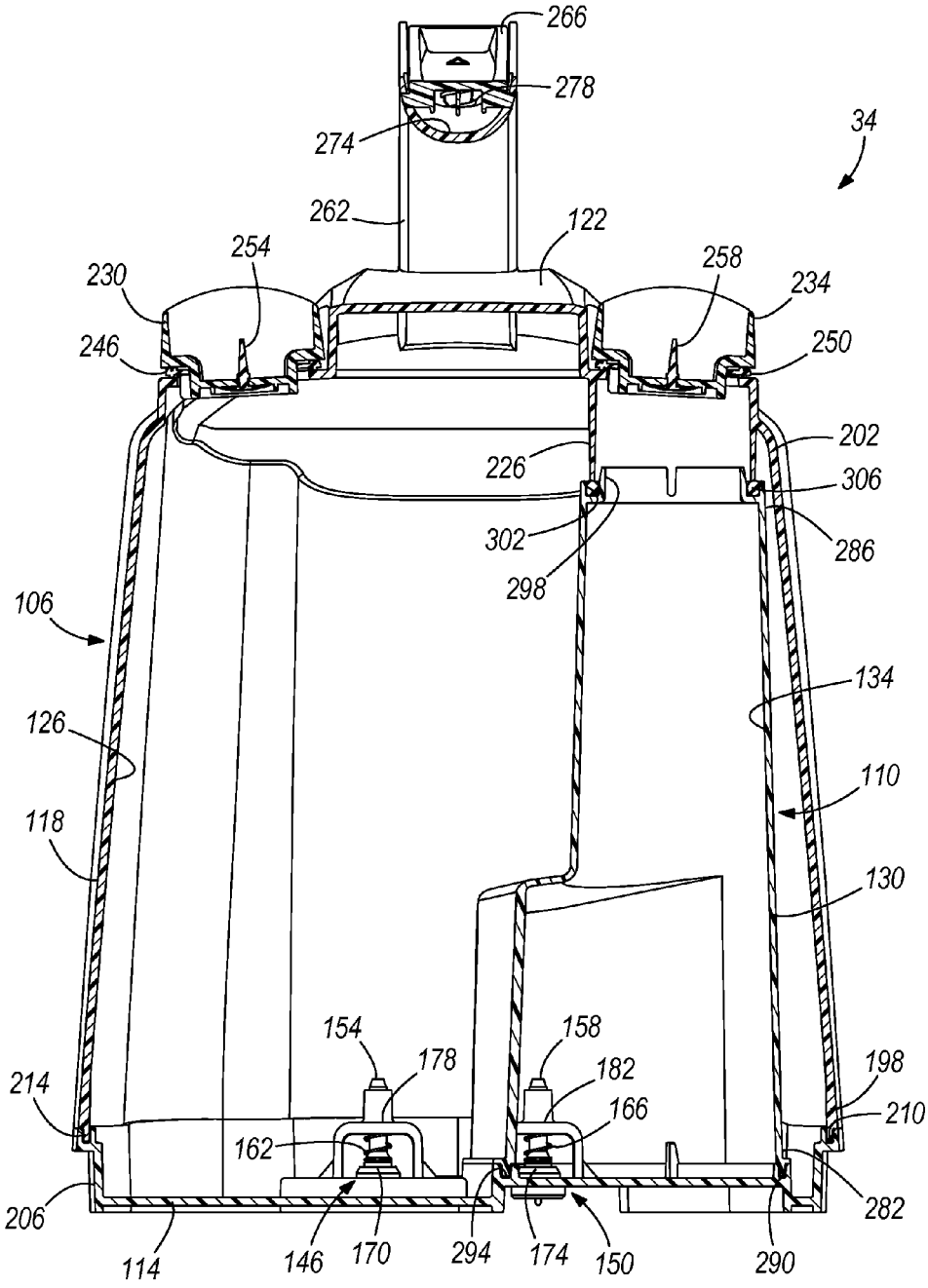
FIG. 5 is a cross-sectional view of the supply tank assembly taken along section line 5-5 of FIG. 3.

As shown in FIGS. 3-5, the supply tank assembly 34 includes two tanks 106, 110 that receive and store two different cleaning fluids. The illustrated supply tank assembly 34 is a tank-in-tank design that separates a first cleaning fluid and a second cleaning fluid until the cleaning fluids are drawn from the tank assembly 34 by the distributor 30. The first tank 106 includes a rigid body defined by a base 114, an exterior sidewall 118, and an upper portion 122 of the supply tank assembly 34. The first tank 106 defines a storage chamber 126 (FIG. 5) for receiving and storing the first cleaning fluid (e.g., water). The second tank 110 includes a rigid body defined by the base 114, an interior sidewall 130, and the upper portion 122 of the supply tank assembly 34. The second tank 110 is positioned at least partially within the storage chamber 126 of the first tank 106 and defines a storage chamber 134 for receiving and storing the second cleaning fluid (e.g., detergent). The first tank 106 and the second tank 110 are considered rigid in that the tanks 106, 110 do not noticeably deflect or deform when the cleaning fluids are added to or drawn out of the tanks 106, 110. Instead, the tanks 106, 110 maintain their shape and size regardless of the presence of the cleaning fluids.

As discussed above, the illustrated supply tank assembly 34 is received in the cavity 54 (FIG. 2) of the handle 18 and supported by the tank tray 58. As such, the supply tank assembly 34 is pivotable with the handle 18 relative to the foot 14. In the illustrated embodiment, the supply tank assembly 34 is removably coupled to the handle 18. When connected to the handle 18 and supported by the tank tray 58, the supply tank assembly 34 is in fluid communication with the distributor 30 to supply the cleaning fluids from the storage chambers 126, 134 of the first and second tanks 106, 110 to the distributor 30. In other embodiments, the supply tank assembly 34 may be supported by the foot 14 of the extractor 10 or may be supported elsewhere on the handle 18.

Referring to FIGS. 4 and 5, the base 114 of the supply tank assembly 34 is shaped and sized to fit on the tank tray 58 (FIG. 2) within the lip 62. The illustrated base 114 defines a first outlet 138 and a second outlet 142. The first outlet 138 is in communication with the storage chamber 126 of the first tank 106 and couples to the first connector 70 (FIG. 2) to supply the first cleaning fluid to the distributor 30. The second outlet 142 is in communication with the storage chamber 134 of the second tank 110 and couples to the second connector 74 (FIG. 2) to supply the second cleaning fluid to the distributor 30.

A first valve 146 is coupled to the base 114 at the first outlet 138 and a second valve 150 is coupled to the base 114 at the second outlet 142. Actuating the first and second valves 146, 150 fluidly connects the first and second tanks 106, 110, respectively, to the distributor 30. In the illustrated embodiment, the first and second valves 146, 150 are poppet valves, although other suitable valves may alternatively be employed. Each valve 146, 150 includes a piston 154, 158, a biasing member 162, 166 (e.g., a coil spring), and a seal 170, 174. The pistons 154, 158 extend through the first and second outlets 138, 142 and are guided by brackets 178, 182 coupled to an inner surface 186 of the base 114. The biasing members 162, 166 are positioned between the inner surface 186 of the base 114 and the brackets 178, 182. The biasing members 162, 166 surround portions of the pistons 154, 158 to bias the pistons 154, 158 to a closed position such that the cleaning fluids do not flow out through the outlets 138, 142. When the supply tank assembly 34 is supported on the tank tray 58, posts 190, 194 (FIG. 2) extending upwardly from the connectors 70, 74 engage the pistons 154, 158, lifting the pistons 154, 158 against the bias of the biasing members 162, 166 to an open position. In the open position, the outlets 138, 142 fluidly connect the first and second tanks 106, 110 to the distributor 30.

Referring to FIGS. 3-5, the exterior sidewall 118 of the supply tank assembly 34 extends upwardly from the base 114. The illustrated exterior sidewall 118 defines an outer boundary of the storage chamber 126 of the first tank 106. The exterior sidewall 118 includes a first, or bottom, end 198 coupled to the base 114 and a second, or top, end 202 coupled to the upper portion 122 opposite the base 114. The bottom end 198 of the exterior sidewall 118 circumscribes an outer perimeter 206 of the base 114. In the illustrated embodiment, the bottom end 198 includes a lip 210 that fits within a groove 214 formed in the base 114 to couple the exterior sidewall 118 to the base 114. The lip 210 is glued within the groove 214 to permanently affix the exterior sidewall 118 to the base 114 and seal the supply tank assembly 34. In other embodiments, the exterior sidewall 118 may be removably coupled to the base 114, may be integrally formed as a single piece with the base 114, or may be coupled to the base 114 using other suitable coupling means. In some embodiments, at least a portion of the exterior sidewall 118 is transparent such that a user may visually identify the amount of cleaning fluid in the first tank 106 and the second tank 110. In other embodiments, other indicator means, such as, for example, a float or an external clear tube, may also or alternatively be employed to indicate the amount of cleaning fluid.

The upper portion 122 is coupled to the top end 202 of the exterior sidewall 118 opposite the base 114. In the illustrated embodiment, the upper portion 122 is integrally formed as a single piece with the exterior sidewall 118. In other embodiments, the upper portion 122 may be a separate piece that is permanently or removably coupled to the exterior sidewall 118. The upper portion 122, the exterior sidewall 118, and the base 114 together define a storage volume of the entire supply tank assembly 34. The storage volume is equal to the volume of the first tank storage chamber 126 plus the volume of the second tank storage chamber 134.

As shown in FIG. 4, the illustrated upper portion 122 defines a first tank inlet 218 and an aperture 222. The first tank inlet 218 extends through the upper portion 122 to the storage chamber 126 of the first tank 106 for filling the first tank 106 with the first cleaning fluid. The aperture 222 also extends through the upper portion 122 and is aligned with the interior sidewall 130. As shown in FIG. 5, the upper portion 122 includes a flange 226 surrounding the aperture 222. The flange 226 extends downwardly from the upper portion 122 toward the base 114 and couples to the interior sidewall 130. The flange 226 directs fluid from the aperture 222 toward the interior sidewall 130 to fill the second tank 110.

In the illustrated embodiment, the first tank inlet 218 and the aperture 222 are located on the upper portion 122 such that both the first tank 106 and the second tank 110 may be filled when the supply tank assembly 34 is connected to and supported by the handle 18. As shown in FIG. 1, no portion of the extractor 10 extends over the supply tank assembly 34 and covers the first tank inlet 218 or the aperture 222 when the tank assembly 34 is supported by the handle 18. As such, a user does not have to remove the supply tank assembly 34 from the extractor 10 in order to access or refill either tank 106, 110.

Referring back to FIGS. 3-5, the supply tank assembly 34 includes a first cap 230 for covering the first tank inlet 218 and a second cap 234 for covering the aperture 222. The illustrated caps 230, 234 include ramped projections 238, 242 that engage the upper portion 122 such that each cap 230, 234 may be rotated less than a full turn (e.g., a quarter-turn) to secure the caps 230, 234 to the upper portion 122. A seal 246, 250 is captured between each cap 230, 234 and the upper portion 122 when the caps 230, 234 are connected to inhibit fluid from leaking out of the tanks 106, 110. A valve member 254, 258 is also coupled to the bottom of each cap 230, 234. The valve members 254, 258 deflect when cleaning fluid is drawn out of the first and second tanks 106, 110 by the distributor 30 to prevent vacuums from forming in the tanks 106, 110.

The illustrated supply tank assembly 34 also includes a tank handle 262 coupled to the upper portion 122 and a latch 266 coupled to the tank handle 262. The tank handle 262 facilitates removing the supply tank assembly 34 from the extractor 10. The tank handle 262 also facilitates carrying and holding the supply tank assembly 34 if a user desires to fill the tanks 106, 110 when the assembly 34 is disconnected from the extractor 10. In the illustrated embodiment, the tank handle 262 is integrally formed as a single piece with the upper portion 122 and extends from the upper portion 122 generally between the first tank inlet 218 and the aperture 222. In other embodiments, the tank handle 262 may be removably coupled to the upper portion 122 or may be located elsewhere on the supply tank assembly 34.

The latch 266 is operable to engage a corresponding surface 270 (FIG. 2) on the handle 18 to releasably secure the supply tank assembly 34 to the extractor 10. The illustrated latch 266 is positioned within a channel 274 formed in the tank handle 262 and may be actuated (e.g., depressed or pivoted) by a user grasping the tank handle 262. A biasing member 278 (e.g., a coil spring) engages the latch 266 to bias the latch 266 into engagement with the corresponding surface 270 on the handle 18 when the supply tank assembly 34 is supported by the handle 18.

As shown in FIGS. 4 and 5, the interior sidewall 130 is located within the storage volume of the supply tank assembly 34 and extends upwardly from the base 114. In the illustrated embodiment, the interior sidewall 130 is a tube that extends between the base 114 and the upper portion 122 to interconnect the base 114 and the upper portion 122. The interior sidewall 130 includes a first, or bottom, end 282 coupled to the base 114 and a second, or top, end 286 coupled to the flange 226 of the upper portion 122. Similar to the exterior sidewall 118, the bottom end 282 of the illustrated interior sidewall 130 includes a lip 290 that fits within and is glued to a groove 294 formed in the base 114. In other embodiments, the interior sidewall 130 may be removably coupled to the base 114, may be integrally formed as a single piece with the base 114, or may be coupled to the base 114 using other suitable coupling means.

The interior sidewall 130 is spaced apart from the exterior sidewall 118 such that the interior sidewall 130 defines an inner boundary of the first tank storage chamber 126 and an outer boundary of the second tank storage chamber 134. The second tank 110 is thereby positioned entirely within the storage chamber 126 of the first tank 106 and within the outer perimeter 206 of the base 114 to separate the first cleaning fluid and the second cleaning fluid. As such, when the first tank storage chamber 126 is filled, the first cleaning fluid surrounds the interior sidewall 130. Similar to the exterior sidewall 118, in some embodiments, at least a portion of the interior sidewall 130 is transparent such that a user may visually identify the amount of cleaning fluid in the second tank 110. In other embodiments, other indicator means, such as, for example, a float, may also or alternatively be employed to indicate the amount of cleaning fluid.

The interior sidewall 130 defines a second tank inlet 298 at the top end 286 for filling the second tank 110 with the second cleaning fluid. The second tank inlet 298 is aligned with the aperture 222 formed in the upper portion 122 such that the inlet 298 extends through the upper portion 122 and the second tank 110 is filled through the aperture 222 and the inlet 298. In the illustrated embodiment, the second tank inlet 298 is located generally beneath and vertically inline with the aperture 222. The flange 226 (FIG. 5) of the upper portion 122 helps define the inlet 298 between the top end 286 of the interior sidewall 130 and the aperture 222. The flange 226 also helps direct fluid being poured through the aperture 222 into the second tank 110. The illustrated interior sidewall 130 defines a groove 302 at the top end 286 adjacent the second tank inlet 298. The groove 302 receives a seal 306, such as, for example, an O-ring. The flange 226 engages the seal 306 to couple the upper portion 122 to the interior sidewall 130 and isolate the second tank storage chamber 134 from the first tank storage chamber 126. The first tank 106 and the second tank 110 thereby maintain the first cleaning fluid and the second cleaning fluid in the separate storage chambers 126, 134 such that the cleaning fluids do not mix until drawn out of the supply tank assembly 34 by the distributor 30.

Although the invention has been described in detail with reference to certain preferred embodiments, variations and modifications exist within the scope and spirit of one or more independent aspects of the invention as described.

Various features and advantages of the invention are set forth in the following claims.

What is claimed is:

1. An extractor cleaning machine comprising:

a foot movable along a surface to be cleaned, the foot including a distribution nozzle and a suction nozzle;

a handle coupled to the foot to facilitate movement of the foot along the surface;

a suction source in fluid communication with the suction nozzle, the suction source operable to draw fluid and dirt from the surface through the suction nozzle;

a recovery tank coupled to at least one of the foot and the handle, the recovery tank in fluid communication with the suction source to receive and store the fluid and dirt drawn through the suction nozzle;

a distributor in fluid communication with the distribution nozzle, the distributor operable to distribute a first cleaning fluid and a second cleaning fluid to the surface through the distribution nozzle; and a supply tank assembly coupled to at least one of the foot and the handle, the supply tank assembly including a first tank in fluid communication with the distributor, the first tank having a rigid body defining a first storage chamber for storing the first cleaning fluid and supplying the first cleaning fluid to the distributor, and a second tank positioned within the first storage chamber of the first tank in fluid communication with the distributor, the second tank having a rigid body defining a second storage chamber for receiving the second cleaning fluid and supplying the second cleaning fluid to the distributor, wherein at least a portion of the rigid body of the second tank defines a boundary of the first storage chamber to separate the first cleaning fluid and the second cleaning fluid.

2. The extractor cleaning machine of claim 1, wherein the second tank is positioned entirely within the first storage chamber to separate the first cleaning fluid and the second cleaning fluid.

3. The extractor cleaning machine of claim 2, wherein the supply tank assembly includes an exterior sidewall that partially defines the first storage chamber, wherein the supply tank assembly includes an interior sidewall positioned within the exterior sidewall such that the interior sidewall is spaced from the exterior sidewall and is configured to be surrounded by the first cleaning fluid.

4. The extractor cleaning machine of claim 1, wherein the rigid body of the first tank defines an inlet for filling the first tank and an aperture, and wherein the rigid body of the second tank defines an inlet aligned with the aperture of the first tank such that the second tank is filled through the inlet of the second tank and the aperture of the first tank.

5. The extractor cleaning machine of claim 1, wherein the supply tank assembly includes a base defining a first outlet for supplying the first cleaning fluid to the distributor and a second outlet for supplying the second cleaning fluid to the distributor, wherein the rigid body of the first tank is partially defined by a portion of the base that includes the first outlet, and wherein the rigid body of the second tank is partially defined by a portion of the base that includes the second outlet.

6. The extractor cleaning machine of claim 5, wherein the supply tank assembly further includes:

a first valve coupled to the base at the first outlet, the first valve actuatable to fluidly connect the first tank to the distributor, and a second valve coupled to the base at the second outlet, the second valve actuatable to fluidly connect the second tank to the distributor.

7. The extractor cleaning machine of claim 1, wherein the supply tank assembly is removably coupled to the at least one of the foot and the handle.

8. The extractor cleaning machine of claim 1, wherein the handle is pivotally coupled to the foot, and wherein the supply tank assembly is coupled to the handle such that the supply tank assembly pivots with the handle relative to the foot.

9. An extractor cleaning machine comprising:

a foot movable along a surface to be cleaned, the foot including a distribution nozzle and a suction nozzle;

a handle coupled to the foot to facilitate movement of the foot along the surface;

a suction source in fluid communication with the suction nozzle, the suction source operable to draw fluid and dirt from the surface through the suction nozzle;

a recovery tank coupled to at least one of the foot and the handle, the recovery tank in fluid communication with the suction source to receive and store the fluid and dirt drawn through the suction nozzle;

a distributor in fluid communication with the distribution nozzle, the distributor operable to distribute a first cleaning fluid and a second cleaning fluid to the surface through the distribution nozzle; and a supply tank assembly coupled to at least one of the foot and the handle, the supply tank assembly including a base defining a first outlet for supplying the first cleaning fluid to the distributor and a second outlet for supplying the second cleaning fluid to the distributor, an exterior sidewall extending upwardly from the base, the exterior sidewall including a bottom end coupled to the base and a top end opposite the bottom end, an upper portion coupled to the top end of the exterior sidewall opposite the base, the upper portion, the base, and the exterior sidewall together defining a storage volume of the supply tank assembly, a first tank for storing the first cleaning fluid, the first tank defined by at least a portion of the exterior sidewall, at least a portion of the upper portion, and a portion of the base, a first tank inlet for filling the first tank, the first tank inlet extending through the upper portion of the supply tank assembly, an interior sidewall extending upwardly from the base and located within the storage volume, a second tank for storing the second cleaning fluid, the second tank at least partially defined by the interior sidewall, at least a portion of the upper portion, and a portion of the base, and a second tank inlet for filling the second tank, the second tank inlet extending through the upper portion of the supply tank assembly.

10. The extractor cleaning machine of claim 9, wherein the upper portion defines an aperture, and wherein the second tank inlet is aligned with the aperture such that the second tank is filled through the second tank inlet and the aperture of the upper portion.

11. The extractor cleaning machine of claim 9, wherein the supply tank assembly is removably coupled to the at least one of the base and the handle such that the first outlet is removably coupled to the distributor and the second outlet is removably coupled to the distributor.

12. The extractor cleaning machine of claim 11, wherein the first tank is fillable through the first tank inlet and the second tank is fillable through the second tank inlet when the first outlet is in fluid communication with the distributor and the second outlet is in fluid communication with the distributor.

13. The extractor cleaning machine of claim 11, wherein the supply tank assembly further includes a tank handle that extends from the upper portion of the first tank.

14. The extractor cleaning machine of claim 9, wherein the supply tank assembly further includes:

a first valve coupled to the base at the first outlet, the first valve actuatable to fluidly connect the first tank to the distributor, and a second valve coupled to the base at the second outlet, the second valve actuatable to fluidly connect the second tank to the distributor.

15. The extractor cleaning machine of claim 9, wherein the handle is pivotally coupled to the foot, and wherein the supply tank assembly is coupled to the handle such that the supply tank assembly pivots with the handle relative to the foot.

16. The extractor cleaning machine of claim 9, wherein the interior sidewall is rigid.

17. The extractor cleaning machine of claim 9, wherein the interior sidewall is located entirely within the storage volume.

18. The extractor cleaning machine of claim 9, wherein the first tank defines a first tank storage chamber for storing the first cleaning fluid, wherein the second tank defines a second tank storage chamber for storing the second cleaning fluid, and wherein the storage volume of the supply tank assembly equals the volume of the first tank storage chamber plus the volume of the second tank storage chamber.

19. The extractor cleaning machine of claim 9, wherein the base defines an outer perimeter that extends around the base, and wherein the exterior sidewall circumscribes the outer perimeter of the base.

20. The extractor cleaning machine of claim 19, wherein the portion of the base that forms the second tank is located within the outer perimeter of the base.

21. An extractor cleaning machine comprising:

a foot movable along a surface to be cleaned, the foot including a distribution nozzle and a suction nozzle;

a handle coupled to the foot to facilitate movement of the foot along the surface;

a suction source in fluid communication with the suction nozzle, the suction source operable to draw fluid and dirt from the surface through the suction nozzle;

a recovery tank coupled to at least one of the foot and the handle, the recovery tank in fluid communication with the suction source to receive and store the fluid and dirt drawn through the suction nozzle;

a distributor in fluid communication with the distribution nozzle, the distributor operable to distribute a first cleaning fluid and a second cleaning fluid to the surface through the distribution nozzle; and a supply tank assembly coupled to at least one of the foot and the handle, the supply tank assembly including a base defining a first outlet for supplying the first cleaning fluid to the distributor and a second outlet for supplying the second cleaning fluid to the distributor, an exterior sidewall extending from the base, the exterior sidewall including a first end coupled to the base and a second end opposite the first end, an upper portion coupled to the second end of the exterior sidewall opposite the base, the upper portion, the exterior sidewall, and the base together defining a storage volume of the supply tank assembly, a tube positioned within the storage volume, the tube extending between the base and the upper portion to interconnect the base and the upper portion, a first tank for storing the first cleaning fluid, the first tank defined by the exterior sidewall, a portion of the upper portion, and a portion of the base, and a second tank for storing the second cleaning fluid, the second tank defined by the tube, a portion of the upper portion, and a portion of the base.

22. The extractor cleaning machine of claim 21, wherein at least a portion of the tube defines a boundary of the first tank to separate the first cleaning fluid and the second cleaning fluid.

23. The extractor cleaning machine of claim 21, wherein the tube is positioned entirely within the storage volume.

24. The extractor cleaning machine of claim 21, wherein the upper portion defines an inlet for filling the first tank and an aperture, and wherein the tube defines an inlet aligned with the aperture such that the second tank is filled through the inlet of the tube and the aperture of the upper portion.

25. The extractor cleaning machine of claim 21, wherein the supply tank assembly is removably coupled to the at least one of the base and the handle such that the first outlet is removably coupled to the distributor and the second outlet is removably coupled to the distributor.

26. The extractor cleaning machine of claim 25, wherein the first tank and the second tank are fillable when the first outlet is in fluid communication with the distributor and the second outlet is in fluid communication with the distributor.

27. The extractor cleaning machine of claim 21, wherein the supply tank assembly further includes:

a first valve coupled to the base at the first outlet, the first valve actuatable to fluidly connect the first tank to the distributor, and a second valve coupled to the base at the second outlet, the second valve actuatable to fluidly connect the second tank to the distributor.

28. The extractor cleaning machine of claim 21, wherein the tube is rigid.

* * * * *